United States Patent [19]

Miller

[11] Patent Number: 5,015,114

[45] Date of Patent: May 14, 1991

[54] MODULAR LOOSE LEAF BINDER SYSTEM AND A BINDER RING USED THEREIN

[76] Inventor: Paul D. Miller, 14 Fifth Ave., New York, N.Y. 10011

[21] Appl. No.: 308,797

[22] Filed: Feb. 10, 1989

[51] Int. Cl.[5] ..... B42F 3/00

[52] U.S. Cl. ..... 402/4; 402/80 R; 402/501; 402/79

[58] Field of Search ..... 402/4, 25, 79, 80 R, 402/501

[56] References Cited

U.S. PATENT DOCUMENTS

| | | | |
|---|---|---|---|
| 1,027,523 | 5/1912 | Buchan | 402/501 |
| 1,037,242 | 9/1912 | Morden . | |
| 1,037,292 | 9/1912 | Morden | 402/501 |
| 2,168,323 | 8/1939 | Bruen | 402/501 X |
| 2,229,414 | 12/1940 | Spinner . | |
| 2,249,064 | 7/1941 | Tauber . | |
| 2,286,911 | 6/1942 | Hayes | 402/501 X |
| 2,413,078 | 12/1946 | Scholfield . | |
| 2,718,229 | 9/1955 | Gregory . | |
| 2,731,017 | 1/1956 | Neilsen | 402/501 X |
| 4,607,970 | 8/1986 | Heusinkveld . | |

FOREIGN PATENT DOCUMENTS

| | | | |
|---|---|---|---|
| 733692 | 10/1932 | France | 402/501 |
| 1261375 | 4/1961 | France | 402/501 |
| 625130 | 9/1961 | Italy | 402/79 |
| 243350 | 12/1946 | Switzerland | 402/501 |

*Primary Examiner*—Paul A. Bell

*Attorney, Agent, or Firm*—Finnergan, Henderson, Farabow, Garrett and Dunner

[57] ABSTRACT

A modular binder ring is disclosed having a disk shaped central portion, an aperture formed substantially in the center of the central portion, and an annular outer rim formed on the periphery of the central portion. The outer rim includes an arcuately shaped outer surface configured as an outer segment of a circle, and has an axial width greater than the axial width of a central portion. Further, there is disclosed a loose leaf modular binder system comprising at least two modular binder rings, with a spine rod extending through the aligned apertures, capable of binding a plurality of loose leaf paper sheets of different lengths and widths. The paper sheets have die cut perforations on one edge sized to fit about the outer rim of the binder rings. The spine rod enables the bound pages to be removably suspended from a storage rack. In another embodiment, the pages are bound to the binder rings without the spine rod extended through the apertures.

4 Claims, 3 Drawing Sheets

MODULAR LOOSE LEAF BINDER SYSTEM AND A BINDER RING USED THEREIN

BACKGROUND OF THE INVENTION

1. Field of the Invention

The present invention relates to binding systems used to secure die-cut perforated sheets of paper within a holder, and more particularly to binder rings for securing and collating the paper sheets.

2. Description of the Related Art

Prior art binders include protruding locking ring notebooks, spiral ring notebooks, rotary wheels, tubular clips, hanging folders, and the like. Examples of prior art binders are disclosed in U.S. Pat. Nos. 2,413,078 (R. P. Scholfield), 1,027,523 (E. E. Buchman), 4,607,970 (Heusinkveld), 2,718,229 (F. F. Gregory), 2,249,064 (R. Tauber), 1,037,292 (L. M. Morden).

The prior art binding devices possess several inadequacies. For example, locking ring notebooks can only accommodate a single size paper, corresponding to the size of the ring mechanism. Locking ring notebooks cannot function as hanging folders for convenient storage. The bulky size of the rings restrict the movement of the pages, not allowing a user to easily flip through the bound pages since the binder rings tend to catch on the page penetrations. Moreover, locking ring binders do not permit the cover and interior pages to be folded back through a full 360°.

Spiral ring notebooks are also limited to a single size paper, cannot function as hanging folders for convenient storage, and leave behind a perforated section when the pages are removed.

Tubular clips and the like are too flimsy to be hung on a support disposed for example in a file drawer, thus precluding convenient storage. Moreover, pages bound with tubular clips do not lay flat, are difficult to fold back 360°, and are restricted in movement due to interference from the clip.

Hanging folders are relatively easy to store, and can lay flat for use, with easy unrestricted movement of the pages. However, such folders do not bind together the loose leaf pages contained therein.

SUMMARY OF THE INVENTION

Therefore, it is an object of the present invention to provide a loose leaf binder system which will securely bind sheets of paper together, and permit individual pages to be easily turned without catching or fraying on the binder rings.

A further object is to provide a modular binder system capable of handling a plurality of different sized sheets of paper on a single spine.

A still further object of the present invention is to provide a binder ring which will permit bound pages and a cover to be easily folded back a full 360° while minimizing fraying of the individual page edges.

A still further object of the present invention is to provide a binder system and ring which may be conveniently hung on a suitable support frame.

A still further object of the present invention is to provide a binder system which can be equally effectively used in a plurality of different embodiments, including cookbooks, presentation folders, photo albums and the like.

Additional objects and advantages of the invention will be set forth in the description which follows, and in part will be obvious from the description, or may be learned by practice of the invention. The objects and advantages of the invention may be realized and attained by means of the instrumentalities and combinations particularly pointed out in the appended claims.

To achieve the foregoing objects, and in accordance with the purposes of the invention as embodied and broadly described herein, there is provided a modular binder ring, comprising a flat disk shaped central portion having a first axial width, with an aperture disposed substantially in the center thereof, and an annular outer rim formed on the periphery of the central portion. The annular rim includes an arcuately shaped outer surface which is configured as an outer segment of a circle.

There is further provided a modular loose leaf binder system comprising at least two of said binder rings, and a plurality of loose leaf paper sheets with die cut perforations proximate an outer edge thereof, said perforations configured to loosely fit on said annular outer rims of said binder rings. The loose leaf paper sheets can be configured of a plurality of different lengths and widths.

There is further provided a modular loose leaf binder system comprising at least two of said binder rings, with a spine rod extending through aligned apertures of said rings, means for suspendedly mounting the spine rod, and a plurality of loose leaf paper sheets with die cut perforations proximate an outer edge thereof, said perforations configured to loosely fit on said annular outer rims of said binder rings. The loose leaf paper sheets can be configured of a plurality of different lengths and widths.

BRIEF DESCRIPTION OF THE DRAWINGS

The accompanying drawings, which are incorporated in and constitute a part of the specification illustrate a preferred embodiment of the invention and, together with a general description given above, and a detailed description of the preferred embodiment given below, serve to explain the principles of the invention.

DESCRIPTION OF THE PREFERRED EMBODIMENT

Figure 1:
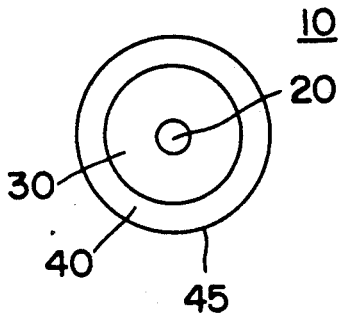
FIG. 1 is a top view of the modular binder ring incorporating the teachings of the present invention.
Figure 2:
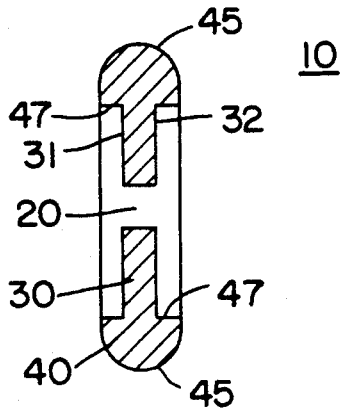
FIG. 2 is a side view of the modular binder ring of FIG. 1.

Reference will now be made in detail to the present preferred embodiment of the invention as illustrated in the accompanying drawings. FIGS. 1 and 2 illustrate a binder ring generally referred to as 10, which is substantially circular in shape. As embodied herein, ring 10 includes a disk shaped central portion 30 having a first predetermined axial width, an aperture 20 formed substantially in the center of central portion 30, and an annular outer rim 40, disposed about the periphery of central portion 30. Outer rim 40 includes an arcuately shaped outer surface 45 configured as an outer segment of a circle, and a flat inner surface 47, and is configured with a second axial width greater than the first axial width of central portion 30. By way of example and not limitation, the binder rings may be formed of a molded synthetic material, such as plastic.

Figure 3:
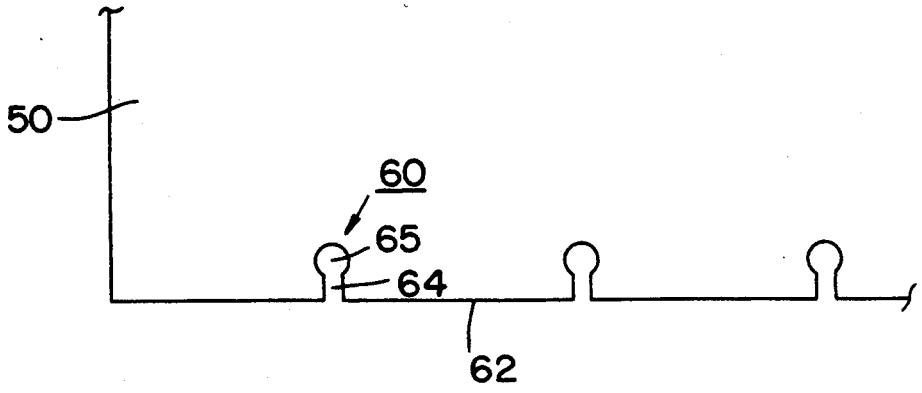
FIG. 3 depicts a portion of a paper sheet with die-cut perforations for insertion on the rings of FIG. 1.

FIG. 3 illustrates die cut perforation 60 disposed adjacent one edge 62 of each loose leaf sheet of paper 50. Preferably, each perforation 60 is configured with a narrow region 64 adjacent edge 62 of sheet 50, and a wide region 65 adjacent narrow region 64. Narrow region 64 is sized slightly larger than the first axial width of central portion 30 and wide region 65 is sized slightly larger than the second axial width of outer rim 40. Wide region 65 may be circular in shape or rectangular. Sheets 50 are detachably held on binder rings 10 by deforming edge 62 of sheet 50 to slide outer rim 40 through narrow section 64 such that the outer rim extends through wide region 65. The paper sheets are held on binder rings 10 by the edges of wide region 65 contacting the inner surface 47 of outer rim 40. The arcuate shape of surface 45 of rim 40 minimizes frictional contact between the edge of wide region 65 and binder ring 10. Thus, sheets 50 can be easily turned with little restriction of movement or fraying of the paper around the cut perforations, and can be folded back through a full 360° around the binder rings.

In accordance with the invention, to bind a plurality of loose sheets of paper, the sheets are first stacked so that all of the die-cut perforations 60 align with one another. An arbitrary number of binder rings 10, less than or equal to the number of penetrations, are then inserted in aligned perforations 60 such that outer annular rim 40 of each binder ring 10 fits into wide region 65 of each die-cut perforation 60. Central portion 30 is thus disposed in narrow section 64 of the die-cut perforation. In this way, the edges of die-cut perforations 60 grip the binder rings along center portions 30 and along inner surface 47 of rim 40, and the sheets are bound together as shown in FIG. 4.

Figure 4:
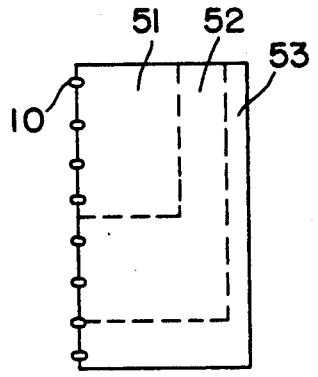
FIG. 4 illustrates a plurality of different sized paper sheets bound with rings incorporating the teachings of the present invention.

As embodied herein, the loose leaf sheets of paper 50 having die cut perforations 60 adjacent one edge thereof can be dimensioned with a plurality of different lengths and widths, for example sheets 51, 52, and 53, as shown in FIG. 4, and still be securely bound on binder rings 10.

Figure 5:
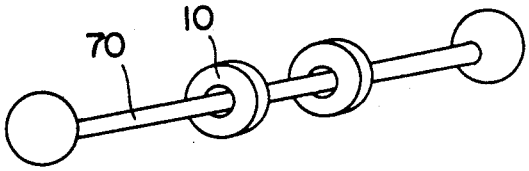
FIG. 5 is a three-dimensional view of a spine rod on which a plurality of modular binder rings of FIG. 1 are mounted.

The present invention further comprises a modular loose leaf binder system incorporating the modular binder rings as disclosed herein. The system includes at least two modular binder rings 10 for receiving a plurality of paper sheets 50. Binder rings 10 are aligned in die-cut perforations 60 and a spine rod 70 is inserted through apertures 20 as illustrated in FIG. 5.

Figure 6:
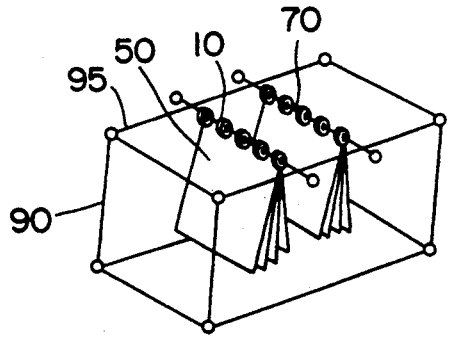
FIG. 6 is a three-dimensional view of a hanging storage rack on which the spine rods and binders of FIG. 5 are mounted.

In accordance with the present invention, the binder system further includes means for suspendedly mounting the spines. As embodied herein, the mounting means includes a box-shaped hanging storage rack 90, shown in FIG. 6, disposed to mount spine rods 70 on upper rails 95 thereof. The hanging storage rack 90 may be dimensioned to fit in a conventional file drawer or other storage cabinet.

Figure 7:
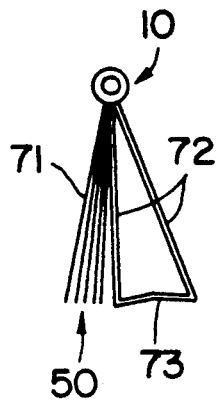
FIG. 7 is a side view of an alternate embodiment of the present invention.
Figure 8:
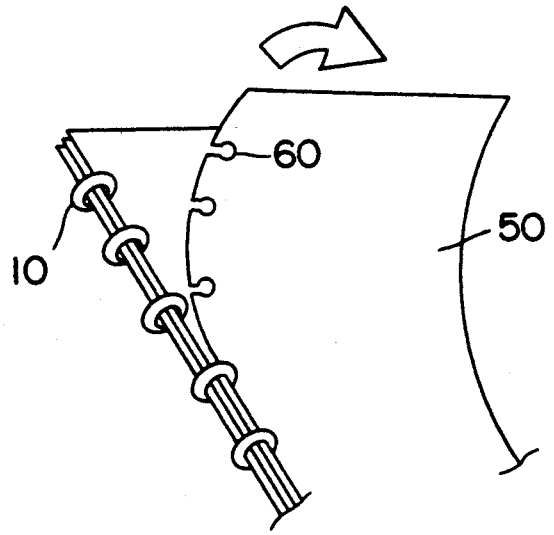
FIG. 8 is a three-dimensional view demonstrating removal of the pages from the modular binder rings.

FIG. 7 shows an alternate embodiment of the present invention, in which bound pages 50 are enclosed with a front and back cover, 71 and 72, respectively, each of which is also configured with the die cut perforations. In this embodiment, back cover 72 is comprised of a double layer of a hard material, with a folding base 73 configured to substantially form a base of a triangle when extended, as shown in FIG. 7. In this embodiment, the back cover serves as an easel, allowing the bound pages to stand up without any other support.

Additional examples to illustrate further uses of the present invention include cookbooks, presentation folders, and the like, all of which will be readily discernable to one skilled in the art.

The present invention permits loose leaf sheets of paper of various sizes to be bound by inserting an arbitrary number of modular binder rings into die-cut perforations provided on one side of the paper sheets. The pages of a notebook bound in accordance with this system can be folded back through a full 360°, and can be turned with very little restriction caused by the binder rings. Further the present invention permits easy removal of individual pages by lifting the edge of the paper having the die-cut perforations away from the modular binder rings. Due to the shape of the binder rings and corresponding shape of the perforations, the paper is released without tearing, fraying, or leaving behind a perforated section. Further, individual pages may be replaced by alignment of the modular binder rings and die-cut perforations and applying fingertip pressure to the paper at points between the binder rings, forcing the perforations to snap into place and grip individual binder rings. This feature permits pages of a certain length and width to be temporarily bound with the rings, along with pages of differing lengths and widths, and later removed from the rings as desired. Further, by inserting a spine rod through the aligned center apertures of the binder rings, the binder may be hung from a storage rack, providing efficient storage capability.

Additional advantages and modifications will readily occur to one skilled in the art. The invention in its broader aspects is, therefore, not limited to the specific details, representative apparatus and illustrative example shown and described. Accordingly, departures may be made from such details without departing from the spirit or scope of applicant's general inventive concept.

What is claimed is:

1. A modular loose leaf binder system, comprising:

a plurality of loose leaf paper sheets having opposing edges, each sheet having a plurality of aligned die-cut perforations proximate one edge thereof, and a predetermined distance from the perforation to said one edge;

at least two modular binder rings for binding said plurality of loose leaf paper sheets, each of said rings including a disk-shaped central portion having a first axial width, an aperture formed substantially in the center of said central portion, and an annular outer rim having an arcuately shaped outer surface configured as an outer segment of a circle, said annular outer rim having a second axial width greater than said first axial width, said outer rim intersecting with said central portion defining an elbow, with a radial distance extending from said aperture to said elbow being greater than the predetermined distance from the perforations to the edge of said paper sheets; and a loose leaf cover having opposing edges and a plurality of die cut perforations proximate one said edge, said perforations extending a predetermined distance from said one edge less than the radial distance from the aperture to the elbow of said binder ring, said cover including a folding base portion opposite the perforated edge.

2. The binder system of claim 1, wherein said loose leaf paper sheets are configured with a plurality of different lengths and widths.

3. The binder system of claim 1, further including a spine rod slidably extendable through said apertures and means for suspendedly mounting said spine rod at times when said spine rod is extended through said apertures.

4. The binder system of claim 3, wherein said mounting means comprises a substantially box-shaped hanging storage rack.

* * * * *